US009715840B1

(12) United States Patent
Warmus

(10) Patent No.: US 9,715,840 B1
(45) Date of Patent: Jul. 25, 2017

(54) SELF-ERECTABLE DISPLAY AND AUTOMATIC LOCKING MECHANISM FOR A SELF-ERECTABLE DISPLAY

(71) Applicant: R. R. Donnelley & Sons Company, Chicago, IL (US)

(72) Inventor: James Warmus, La Grange, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 15/229,920

(22) Filed: Aug. 5, 2016

(51) Int. Cl.
*G09F 15/00* (2006.01)
*G09F 1/06* (2006.01)
*G09F 7/18* (2006.01)

(52) U.S. Cl.
CPC ..... *G09F 1/065* (2013.01); *G09F 2007/1856* (2013.01)

(58) Field of Classification Search
CPC .. G09F 1/065; G09F 15/0031; G09F 15/0056; G09F 15/0062; G09F 2007/1856
USPC ..... 40/606.01, 610, 124.08, 124.14, 124.19
See application file for complete search history.

(56) References Cited

U.S. PATENT DOCUMENTS

| | | | |
|---|---|---|---|
| 822,841 | A | 6/1906 | Hill |
| 956,916 | A | 5/1910 | Wiederseim, Jr. |
| 1,028,147 | A | 6/1912 | Stranders |
| 1,545,771 | A | 7/1925 | Hout |
| 1,576,672 | A | 3/1926 | Miller |
| 1,656,341 | A | 1/1928 | Smith |
| 1,670,464 | A | 5/1928 | Marsh |

(Continued)

FOREIGN PATENT DOCUMENTS

| | | |
|---|---|---|
| CN | 203192354 | 9/2013 |
| DE | 2658506 | 1/1978 |

(Continued)

OTHER PUBLICATIONS

International Searching Authority, "International Search Report and Written Opnion", issued in connection with PCT Application No. PCT/US2016/064478, mailed on Jan. 24, 2017, 15 pages.
United States Patent and Trademark Office, "Non-Final Office Action," issued in connection with U.S. Appl. No. 14/709,266, mailed on May 23, 2016, 22 pages.

(Continued)

*Primary Examiner* — Joanne Silbermann
(74) *Attorney, Agent, or Firm* — Hanley, Flight & Zimmerman, LLC

(57) ABSTRACT

A display apparatus includes a shroud having first and second sheet portions disposed in opposition to one another, the first and second sheet portions being connected to one another at a first side by a first joint and at a second side by a second joint. A support member is disposed between the first and second sheet portions and between the first and second joints, the support member being affixed to the first and second sheet portions and movably disposed relative to the first and second joints, the support member being positionable between a closed position and an open position, the open position outwardly biasing the support member against the first and second sheet portions to cause the shroud to assume a curvilinear cross-sectional shape along a length of the shroud. Notches are formed in the first and second joints at a first position along the length of the shroud. One or more elastic members couple the support member the first and/or second joints and bias the support member into the open position and toward engagement with the notches.

22 Claims, 11 Drawing Sheets

(56) References Cited

U.S. PATENT DOCUMENTS

| | | | | |
|---|---|---|---|---|
| 1,687,616 | A | 10/1928 | Huye | |
| 1,902,566 | A | 3/1933 | Marsh | |
| 2,108,349 | A | 2/1938 | Rasmussen | |
| 2,113,288 | A | 4/1938 | Berger | |
| 2,142,826 | A | 1/1939 | Rosello | |
| 2,153,460 | A | 4/1939 | Giles | |
| 2,210,317 | A | 8/1940 | Dueringer | |
| 2,283,406 | A | 5/1942 | Bacon | |
| 2,290,144 | A | 7/1942 | Katz | |
| 2,404,089 | A | 7/1946 | Pollock | |
| 2,601,374 | A | 6/1952 | Ditzler et al. | |
| 2,637,924 | A | 5/1953 | Hutt | |
| 2,728,461 | A | 12/1955 | Paige | |
| 2,773,324 | A | 12/1956 | Drueck, Jr. | |
| 2,833,074 | A | 5/1958 | Jannes | |
| 2,892,276 | A | 6/1959 | Nelson | |
| 2,918,178 | A | 12/1959 | Leone | |
| 2,984,920 | A | 5/1961 | Acosta et al. | |
| 3,015,898 | A | 1/1962 | Keeslar | |
| 3,091,877 | A | 6/1963 | Luchsinger | |
| 3,234,682 | A | 2/1966 | Frankl | |
| 3,267,597 | A | 8/1966 | Jannes | |
| 3,302,321 | A | 2/1967 | Walker | |
| 3,571,958 | A | 3/1971 | Stevens et al. | |
| 3,665,669 | A | 5/1972 | Huber | |
| 3,666,607 | A | 5/1972 | Weissman | |
| 4,234,148 | A | 11/1980 | Maddestra et al. | |
| 4,610,363 | A | 9/1986 | Flum et al. | |
| 4,619,426 | A | 10/1986 | Drueck, Jr. | |
| 4,750,283 | A | 6/1988 | Halpern | |
| 4,770,379 | A | 9/1988 | Estvold | |
| 4,773,622 | A | 9/1988 | Herlin | |
| 4,774,780 | A | 10/1988 | Crowell | |
| 4,790,714 | A | 12/1988 | Schnapp | |
| 4,854,060 | A | 8/1989 | Corbo et al. | |
| 4,940,199 | A | 7/1990 | Hall | |
| 4,984,848 | A | 1/1991 | Scalisi et al. | |
| 4,993,846 | A | 2/1991 | Diamond et al. | |
| 5,000,717 | A | 3/1991 | Pfeiffer | |
| 5,193,466 | A | 3/1993 | Eder | |
| 5,197,631 | A | 3/1993 | Mishima | |
| 5,297,677 | A | 3/1994 | Burian et al. | |
| 5,416,997 | A | 5/1995 | Dyment et al. | |
| 5,454,180 | A * | 10/1995 | Volpe | G09F 1/065 40/539 |
| 5,467,547 | A | 11/1995 | Fortner | |
| 5,632,390 | A | 5/1997 | Podergois | |
| 5,752,649 | A | 5/1998 | Weder | |
| 5,758,438 | A | 6/1998 | Crowell | |
| 5,778,959 | A | 7/1998 | Guetschow | |
| 5,787,621 | A | 8/1998 | Leksell | |
| 5,809,673 | A | 9/1998 | Johnson et al. | |
| 5,868,367 | A | 2/1999 | Smith | |
| 5,878,945 | A | 3/1999 | Weder | |
| 5,937,553 | A | 8/1999 | Maran | |
| 5,966,857 | A * | 10/1999 | Pettersson | G09F 1/06 40/606.12 |
| 5,983,538 | A | 11/1999 | Crowell | |
| 6,311,418 | B1 | 11/2001 | Crowell | |
| 6,347,772 | B1 | 2/2002 | L'Hotel | |
| 6,497,601 | B1 | 12/2002 | Ward | |
| 7,134,230 | B1 | 11/2006 | Boens et al. | |
| 7,159,350 | B2 * | 1/2007 | L'Hotel | A47F 5/112 40/124.07 |
| 7,234,253 | B2 | 6/2007 | Ossmann | |
| 7,437,842 | B2 | 10/2008 | Sgambellone | |
| 7,634,865 | B2 * | 12/2009 | L'Hotel | G09F 1/06 40/539 |
| 7,726,054 | B2 | 6/2010 | Mestres Armengol et al. | |
| 7,774,964 | B2 | 8/2010 | L'Hotel | |
| 7,980,013 | B2 | 7/2011 | Hsu | |
| 8,099,883 | B2 * | 1/2012 | Mestres Armengol | A47F 5/10 40/124.07 |
| 8,112,925 | B2 * | 2/2012 | Tzuo | G09F 1/065 248/147 |
| 8,291,631 | B2 | 10/2012 | Wilder | |
| 8,458,939 | B2 | 6/2013 | Arthur et al. | |
| 8,590,188 | B2 | 11/2013 | Mirsch | |
| 8,701,321 | B2 | 4/2014 | Da Fonseca et al. | |
| 8,776,415 | B2 * | 7/2014 | Kawaguchi | G09F 1/06 40/124.07 |
| 8,826,833 | B1 * | 9/2014 | Fischer | A47B 43/02 108/162 |
| 8,863,418 | B2 | 10/2014 | Acker et al. | |
| 8,875,908 | B2 | 11/2014 | L'Hotel | |
| 9,173,485 | B2 | 11/2015 | Fischer et al. | |
| 2004/0111930 | A1 | 6/2004 | Ossmann | |
| 2008/0066353 | A1 | 3/2008 | Mills | |
| 2008/0083146 | A1 | 4/2008 | Presa | |
| 2010/0072330 | A1 | 3/2010 | Tzuo | |
| 2010/0236117 | A1 | 9/2010 | Mestres Armengol et al. | |
| 2011/0088300 | A1 | 4/2011 | Martin Presa | |
| 2012/0227297 | A1 | 9/2012 | Kawaguchi et al. | |
| 2013/0219760 | A1 | 8/2013 | Acker et al. | |
| 2014/0265777 | A1 | 9/2014 | Fischer et al. | |
| 2016/0335925 | A1 | 11/2016 | Ruhaak | |
| 2016/0335934 | A1 | 11/2016 | Lyon | |
| 2016/0335935 | A1 | 11/2016 | Lyon | |

FOREIGN PATENT DOCUMENTS

| | | |
|---|---|---|
| DE | 4005925 | 10/1991 |
| DE | 4314654 | 11/1994 |
| DE | 9320993 | 8/1995 |
| DE | 202010015312 | 1/2011 |
| DE | 202011002980 | 5/2011 |
| DE | 202014106297 | 3/2015 |
| DK | 9500055 | 5/1995 |
| DK | 9500277 | 9/1995 |
| EP | 1741368 | 1/2007 |
| EP | 1830334 | 9/2007 |
| EP | 1926076 | 5/2008 |
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 7/1974 |
| FR | 2232259 | 12/1974 |
| FR | 2233912 | 1/1975 |
| FR | 2571949 | 4/1986 |
| FR | 2574968 | 6/1986 |
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2911425 | 7/2008 |
| FR | 2925203 | 6/2009 |
| FR | 2925204 | 6/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| WO | 9634379 | 10/1996 |
| WO | 9936900 | 7/1999 |
| WO | 2002095719 | 11/2002 |
| WO | 2004044867 | 5/2005 |
| WO | 2006040438 | 4/2006 |
| WO | 2006067252 | 6/2006 |
| WO | 2007138083 | 12/2007 |
| WO | 2008049176 | 5/2008 |
| WO | 2010019086 | 2/2010 |

(56) References Cited

FOREIGN PATENT DOCUMENTS

| | | |
|---|---|---|
| WO | 2010130485 | 11/2010 |
| WO | 2011092209 | 8/2011 |
| WO | 2011113123 | 9/2011 |
| WO | 2012061375 | 5/2012 |
| WO | 2016057067 | 4/2016 |

OTHER PUBLICATIONS

United States Patent and Trademark Office, "Notice of Allowance," issued in connection with U.S. Appl. No. 14/709,266, mailed on Sep. 26, 2016, 31 pages.
United States Patent and Trademark Office, "Non-Final Office Action," issued in connection with U.S. Appl. No. 14/709,285, mailed on Sep. 15, 2016, 38 pages.
United States Patent and Trademark Office, "Non-Final Office Action," issued in connection with U.S. Appl. No. 14/711,739, mailed on Sep. 16, 2016, 91 pages.
United States Patent and Trademark Office, "Final Office Action," issued in connection with U.S. Appl. No. 14/709,285, on Mar. 15, 2017, 24 pages.
United States Patent and Trademark Office, "Final Office Action," issued in connection with U.S. Appl. No. 14/711,739, mailed on Mar. 21, 2017, 19 pages.
United States Patent and Trademark Office, "Non-Final Office Action," issued in connection with U.S. Appl. No. 14/988,616, mailed on Apr. 11, 2017, 36 pages.
United States Patent and Trademark Office, "Notice of Allowance," issued in connection with U.S. Appl. No. 14/709,266, mailed on Apr. 12, 2017, 17 pages.

* cited by examiner

SELF-ERECTABLE DISPLAY AND AUTOMATIC LOCKING MECHANISM FOR A SELF-ERECTABLE DISPLAY

FIELD OF THE DISCLOSURE

This disclosure relates generally to displays and, more particularly, to self-erectable displays, methods of making such self-erectable displays, and mechanisms for maintaining such self-erectable displays in an erect state.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawings and accompanying written description to refer to the same or like parts.

DETAILED DESCRIPTION

Figure 1:
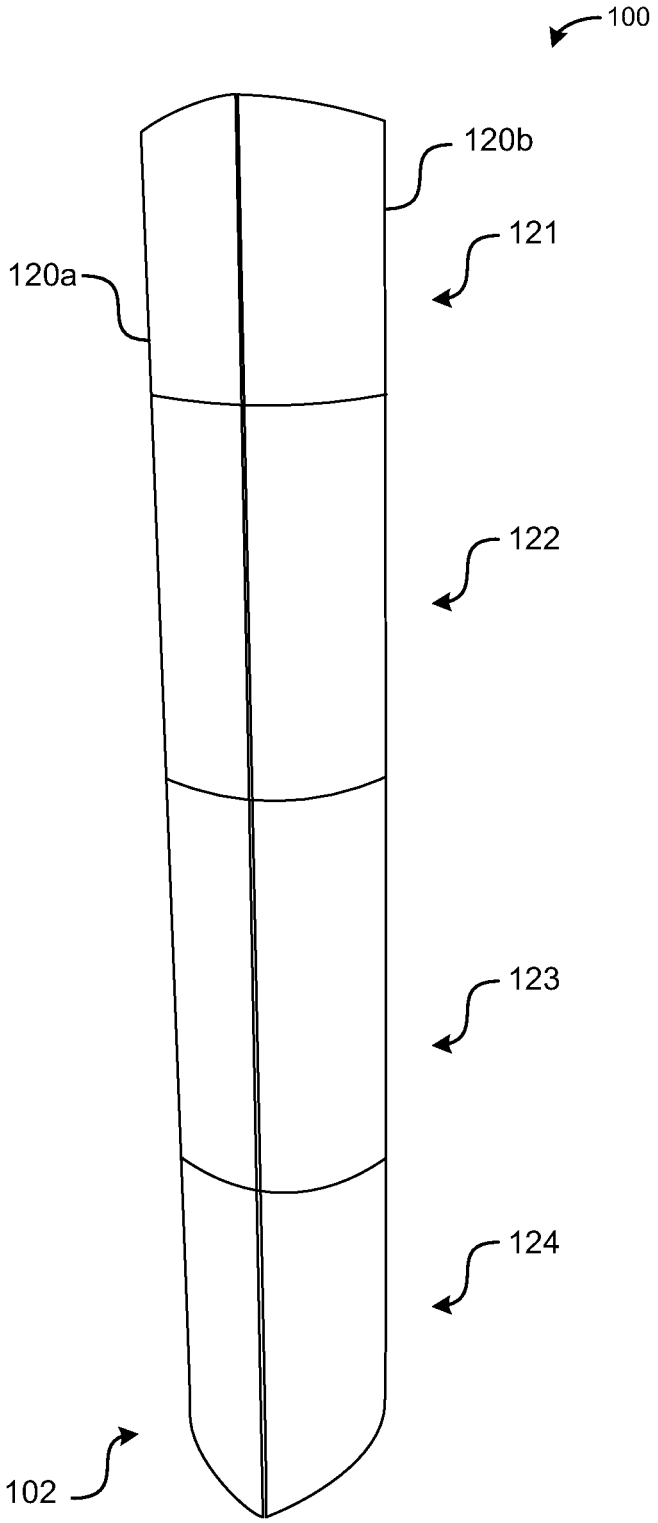
FIG. 1 is a perspective view of an example an erectable display, showing a shroud, in an erected state in accord with teachings disclosed herein.

The examples disclosed herein relate to self-erectable displays that can be used for point-of-sale advertising, providing information or for other suitable purposes. The example self-erectable displays disclosed herein are configured to be collapsed to a folded, flat state, which facilitates shipping and transport, and readily erected at a location (e.g., a point-of-sale, a conference booth, a store, etc.) to effect a desired display function.

In some examples disclosed herein, the example self-erectable displays include one or more substrates (e.g., a sheet material, a panel, etc.) that, singly or in combination, form a tubular shroud into which one or more internal support structures are disposed or are able to be disposed. In some examples, the shroud defines a generally oblong cross-section having, along a longitudinal direction thereof (e.g., a height), a major axis dimension (e.g., a width) and a minor axis dimension (e.g., a depth). A base structure is optionally attached to or integrated with one or more portions of the shroud, such as a base portion, to help to maintain the shroud in a desired orientation. While one particular example of an oblong curvilinear (curved) cross-section for the shroud is depicted herein, the present concepts include other manners of cross-sectional profile for the shroud including, but not limited to, a triangular, square, diamond, circular, or other semi-circular, elliptical, polygonal shape and/or non-polygonal shapes. The shape assumed by a particular shroud may or may not correspond to a shape of support member(s) disposed therein (e.g., a polygonal support member may be used to generate a shroud having a curvilinear profile, etc.).

In some examples, the example shroud is formed of an elongate substrate having top and bottom edges and first and second side edges. To enable the example self-erectable display to be folded for transport or shipping and/or storage, in some examples, longitudinal lines of weakness and/or transverse lines of weakness are defined by the shroud. These lines of weakness enable the example self-erectable display to be folded relatively flat, with adjacent segments of the shroud being folding against one-another along the lines of weakness, such as in a multi-part z-fold, for example. In accordance with the teachings herein, a display apparatus having more than one segment advantageously includes a first sheet portion and a second sheet portion, collectively defining a shroud when assembled, wherein each of the first sheet portion and the second sheet portion include a line of weakness transverse to the length or height (when erected) of the shroud so that the shroud is foldable about the line(s) of weakness.

In some examples, as noted above, the shroud is formed from separate substrates that are coupled together to form a 3-D structure defining an interior volume. In some examples, the example support is formed of two substrates and one or more support portions disposed therein. In some examples, the support portions are generally planar. In yet further examples, the support portions are generally planar and are further advantageously provided with a line of weakness to enable the support portion to be folded relatively flat within the example shroud for transport, shipping and/or storage.

As is described herein, the self-erectable display is formed by (1) assembling one or more substrates together with one or more support portions or (2) by unfurling a completed self-erectable display from a folded state.

FIG. 1 illustrates an example of a self-erectable display 100 including a tubular-shaped shroud 120 formed from two sheets 120*a*, 120*b* and defining an interior volume therebetween. In the example shown, the self-erectable display 100 is supported by a base portion 102 of the shroud 120. In another aspect of the present concepts, the tubular-shaped shroud 120 is formed from a single sheet having two parts (e.g., 120*a*, 120*b*) connected by a central line of weakness, or joint. The two halves of the sheet are folded about the line of weakness so that the distal edges of the sheet abut one another and are connectable to form a joint to thereby define the tubular-shaped shroud. The shroud 120 is optionally coupled to a separate base (not shown).

As shown in the example of FIG. 1, the shroud 120 includes four segments 121-124, each segment being connected to an adjacent segment by a line of weakness, or joint, to facilitate deployment and/or stowage. In other aspects, the shroud 120 may comprise n segments, where n is any number including, but not limited to, 1 segment, 2 segments, 3 segments, 4 segments (as shown), or more than 4 segments.

Figure 2:
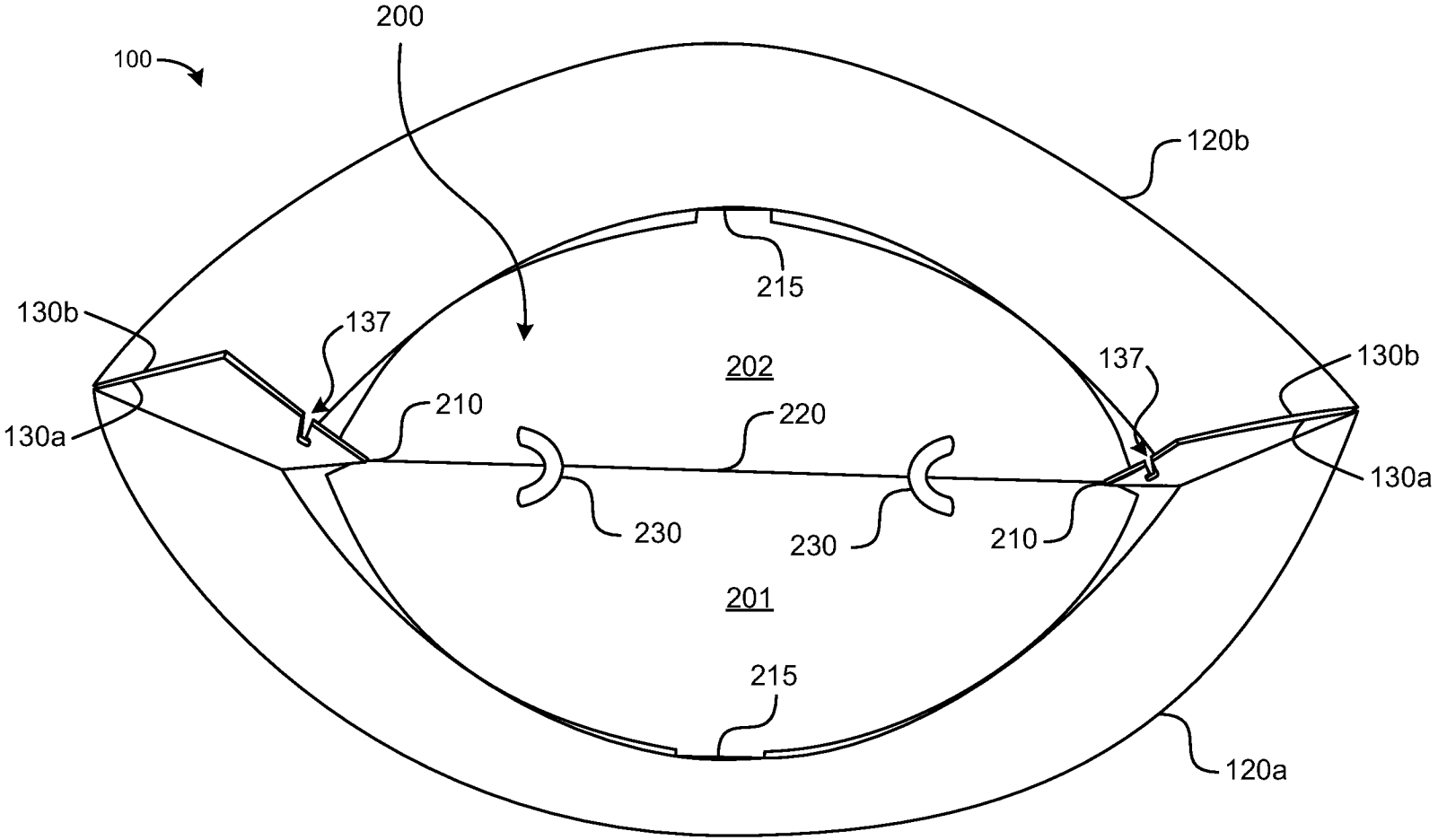
FIG. 2 is a top view of the erected display of FIG. 1, showing an interior volume defined by the shroud and showing an example of a support member in accord with teachings disclosed herein.

FIG. 2 shows a top down view of an example of a shroud 120 support member 200 disposed between the opposing first sheet or sheet portion 120*a* and second sheet or sheet portion 120*b* to extend between the first joint 130 formed by flaps 130*a*, 130*b* (left side of FIG. 2) and the second joint 130 formed by flaps 130*a*, 130*b* (right side of FIG. 2). The example support member 200 shown in FIG. 2 is curvilinear in profile and, in presently preferred aspects, is an ovoid, elliptical or oblong shape having a major axis extending between the first joint and the second joint of the shroud 120. In other aspects, the support member 200 could comprise a different curvilinear shape, such as a circular shape, a polygonal shape, or a polygon approximating a curvilinear shape (e.g., a heptagon, nonagon, or hendecagon, approximating a circular shape, etc.), or a truncated curvilinear or polygonal shape (e.g., an elliptical shape truncated at an end so as to cause such support member 200 to engage only one joint 130 in a deployed position of the shroud 120 via the slot 210 and notch 136 connection disclosed herein). In the latter aspect, the elastic member 400 is advantageously omitted from the side of the support member 200 that is truncated or, alternatively, a different elastic member and/or vertical positioning of an attachment of the elastic member to the shroud is used to account for any asymmetry of force vectors.

The support member 200 is disposed between the first sheet 120*a* and the second sheet 120*b*, and between the first joint 130 and the second joint 130, to outwardly bias the first sheet 120*a* and the second sheet 120*b* and, more particularly, central portions thereof, to cause the shroud 120 to assume a curvilinear cross-sectional shape along at least a portion of a longitudinal axis or length of the shroud and, more preferably, along an entire longitudinal axis of the shroud. In the illustrated example, the support member 200 has an ovoid shape and has a line of weakness 220, or joint, extending along a major axis from the first joint 130 to the second joint 130 and defining a first half 201 and a second half 202 of the support member 200.

In the example shown in FIG. 2, the first sheet 120*a* defines flaps 130*a* at side or lateral portions thereof and, similarly, the second sheet 120*b* defines flaps 130*b* at side or lateral portions thereof. In the assembled state represented in FIG. 2, the flaps 130*a*, 130*b* fold inwardly and cooperatively form a joint 130 that serves as a structural element extending into the interior volume defined by the sheets 120*a*, 120*b*.

Figure 7B:
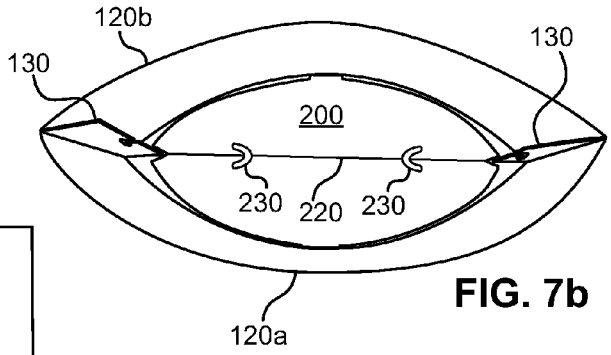
FIGS. 7(*a*)-7(*c*) are, respectively, a side cross-sectional view, a top view and a bottom view of an auto-erected display being collapsed in preparation of folding in accord with teachings disclosed herein.
Figure 7A:
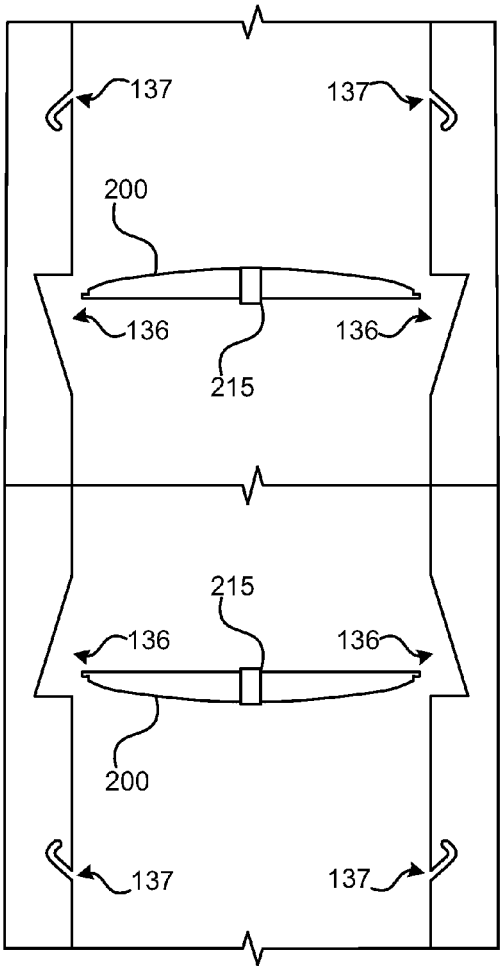
Figure 7C:
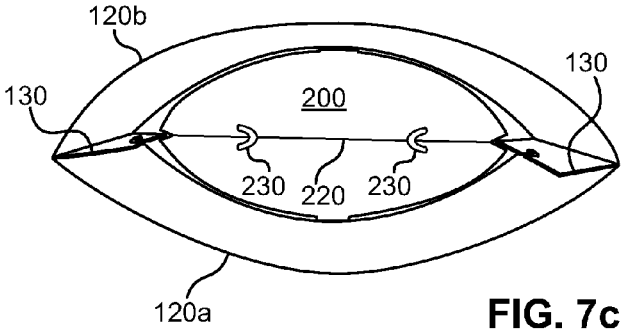
Figure 8B:
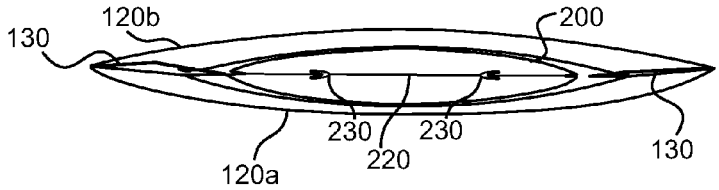
FIGS. 8(*a*)-8(*c*) are, respectively, a side cross-sectional view, a top view and a bottom view of an auto-erected display in a collapsed state prior to folding for stowage in accord with teachings disclosed herein.
Figure 8A:
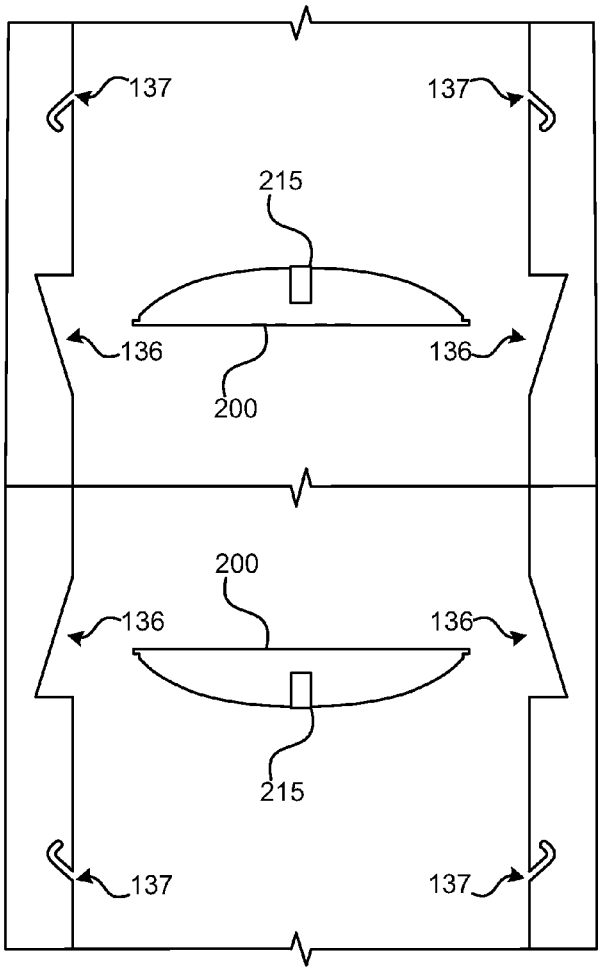
Figure 8C:
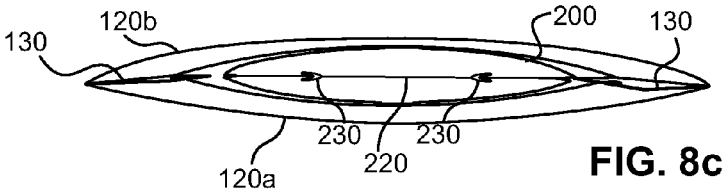

In the example depicted in the accompanying figures, the flaps 130*a*, 130*b* are connected together to form joints 130 connecting sheet 120*a* to sheet 120*b*. This connection between flaps 130*a*, 130*b* comprises, in one example, one or more connection members provided at one or more points along the flaps and, preferably, one or more connection members provided at one or more points per segment (e.g., 121-124). In the illustrated example, the connection members comprise resilient members 140 (see, e.g., FIGS. 3, 4(*f*), 7). In one example, the resilient members 140 comprise a mechanical fastener 132 (e.g., a locking bar, etc.) disposed at each end. In such configuration, as is shown in FIGS. 7-8, the resilient member 140 is pulled taught and stretched between features 131 (e.g., slits, openings, etc.) in the flaps 130*a*, 130*b*, with the locking bar 132 being passed through the features 131 to pull the flaps into engagement with one another upon release of the resilient member. In one aspect, the features 131 comprise eyelets formed in the flaps 130*a*, 130*b* to receive and secure the connection members. In this configuration, the resilient member 140 predominantly contacts a first flap (e.g., 130*a*), with the mechanical fasteners being situated to contact the second flap (e.g., 130*b*). In yet another example, the resilient members 140 comprise conventional rubber bands.

Figure 3:
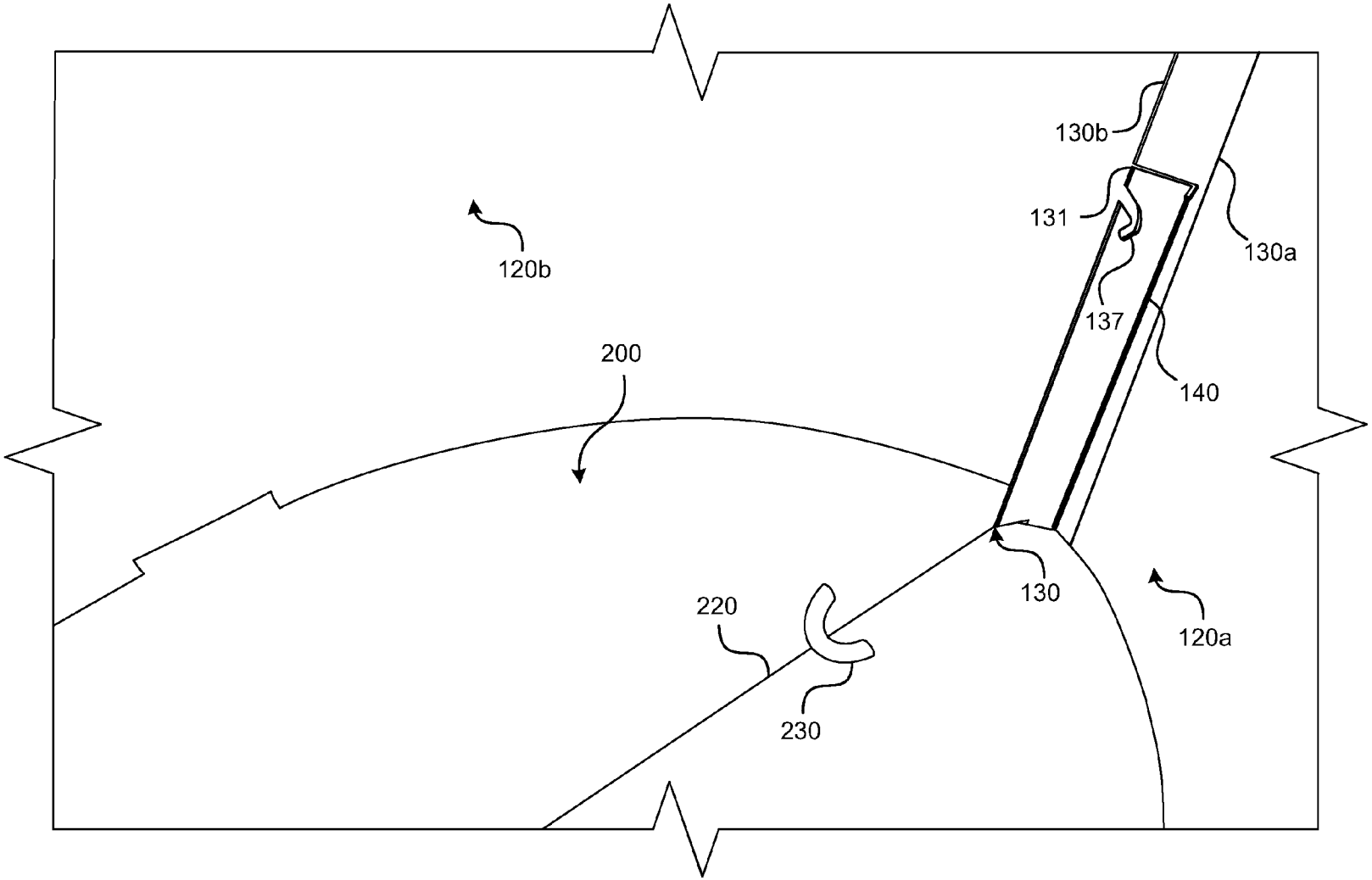
FIG. 3 is a close-up view of the deployed support member of FIG. 2 in accord with teachings disclosed herein.

Alternatively, other types of connection means (e.g., adhesive, thermal bonding, snap connectors, etc.) can be used to connect the sheets 120*a*, 120*b* together at the flaps 130*a*, 130*b* at one or more points and, preferably, at one or more points per segment 121-124. Advantageously, the flaps 130*a*, 130*b* are shaped to resist dislodging of a resilient member and comprise features 131, such as is shown in FIG. 3, or other features (e.g., hook shaped features, recesses, etc.) by which connection members may be anchored or tied down. In some examples, the flaps 130*a*, 130*b* are held together by one or more of flap features arranged to interlock or to provide a mechanical friction fit. In still additional examples, the flaps 130*a*, 130*b* comprise clips, hook-and-eye fasteners, hook-and-loop fasteners (e.g., VELCRO® brand fasteners, etc.), pins, snap fasteners, string, twist ties, bonding agents and/or adhesives, in any combination.

Where the shroud 100 uses a single sheet 120 having flaps 130*a*, 130*b* disposed at either lateral end and a line of weakness centrally disposed therebetween to form a first joint 130, the flaps 130*a*, 130*b* are folded onto one another in opposition about the axis of rotation defined by the line of weakness. Once the flaps 130*a*, 130*b* are disposed to abut one another, across the segments (e.g., 121-124), the flaps 130*a*, 130*b* are physically connected to one another to form the second joint of the shroud 100. In such embodiment, an external flap member is optionally installed along or adjacent the first joint 130 to form a flap member corresponding to flaps 130*a*, 130*b* in opposition to flaps 130*a*, 130*b*. Alternatively, external securement members (e.g., bracket, connector, ledge, projection, etc.) are disposed along or adjacent one or more points at the first joint 130 to form a point or points of securement for the support member along the first joint.

Figure 5:
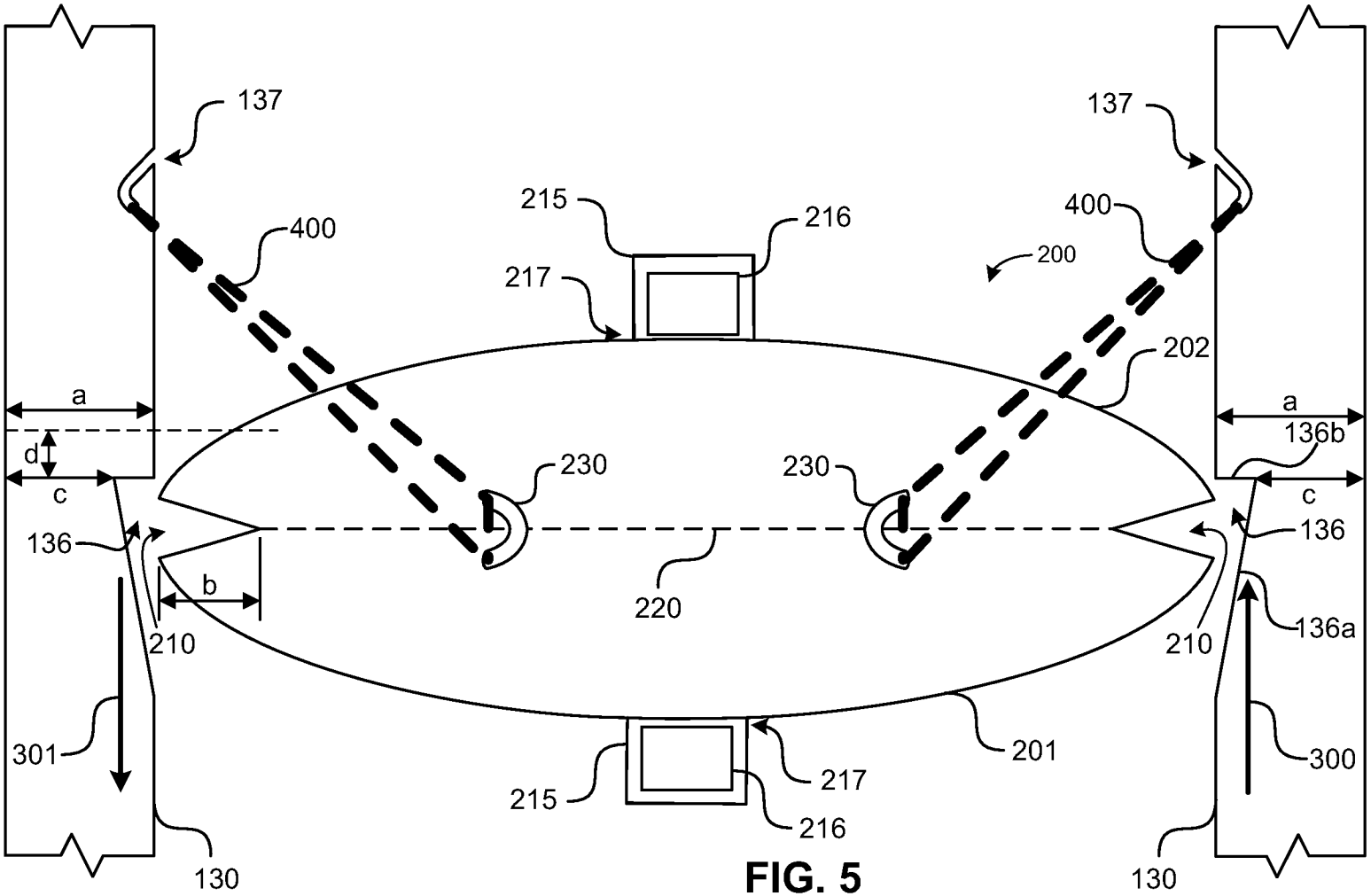
FIG. 5 is a top view of the support member of FIG. 2 in accord with teachings disclosed herein.

FIGS. 2 and 5 show an example wherein a support member 200 includes example tabs 215 centrally disposed along a longitudinal axis, or major axis, of the support member. These tabs 215 are provided to facilitate additional points of connection between the support member 200 and the sheets 120*a*, 120*b*. In particular, an adhesive or an adhesive member 216 (see FIG. 5) is provided on the tab 215, on the respective sheets 120*a*, 120*b*, or on both the tab 215 and the respective sheets 120*a*, 120*b*, to securely couple the support member to the sheets 120*a*, 120*b*. In other examples, no tabs are provided and connection between the support member and the sheets 120*a*, 120*b* is achieved via adhesive or adhesive members. Whereas the top view of the support member 200 of FIG. 5 shows the tabs 215 extending outwardly therefrom, upon installation of the support member into the shroud 120, the tabs are rotated downwardly (or optionally upwardly) to place the region bearing the adhesive member 216 in opposition to the sheets 120*a*, 120*b* to permit adhesive connection thereto, as shown in FIG. 2. While only two tabs 215 are shown, the present concepts contemplate inclusion of additional tabs or lateral connection points between the support member 200 and the sheets 120*a*, 120*b*.

Additional contact points between the support member 200 and the sheets 120*a*, 120*b* are provided, inter alia, via one or more slot(s) 210. FIG. 5 shows an example of one configuration of a cutout 210 in one example of a support member 200. The cutout 210 is centrally disposed along a major axis of the support member, as is the line of weakness 220, and is disposed to matingly engage the joints 130 of the shroud 120 at the notch 136. As noted above, in the illustrated example, the first and second joints 130 are formed by flaps 130*a*, 130*b* of the first and second sheets 120*a*, 120*b*, the flaps 130*a*, 130*b* (collectively forming flap or joint 130) projecting inwardly into an interior volume of the shroud 120, such as is shown in FIGS. 2-3. These flaps or joints 130 engage correspondingly dimensioned cutouts 210 in the support member 200.

FIG. 5 more particularly shows an example of notches 136 formed in the example flaps 130*a*, 130*b* that define the example joints 130. In this example, a width (dimension "a") of the first and second joints 130 is greater than a depth (dimension "b") of lateral cutouts 210 formed in the support member 200 at distal ends of a major axis thereof. Further, in this example, a depth of the lateral cutouts 210 formed in the support member 200 is greater than a width (dimension "c") of the first and second joints at a deepest portion 136*b* of the notches 136. In other examples, the lateral cutouts 210 have different shapes, but retain an overall depth "b" that is less than an overall width "a" of the first and second joints 130, so that a portion of the first and second joints 130 overlap a portion of a surface of the support member when the lateral cutouts are disposed within a notch 136 in the first and second joints 130 of a width/depth "c". In one example, the lateral cutouts 210 are rectangular in shape. In another example, the lateral cutouts are angled in outer lateral portions of the cutouts, similar to that shown in FIG. 5, to provide and angled guide or chamfer, but change in angle, either continuously or abruptly within the cutout (e.g., transition from a first angle to a second angle at a point in the cutout or over a range of depths of the cutout). In yet another example, the lateral cutouts 210 are curvilinear.

In the illustrated example notches 136, a first or transitional portion 136*a* of the notches is angled inwardly into the flap 130 over a length of the flap 130 in a direction 300 of opening for the support member 200. As the support member 200 opens during erecting of the shroud 120, with the joint or line of weakness 220 moving in the direction 300 of opening as the flaps or joints 130 simultaneously moving laterally inwardly toward the support member 200, the transitional portion 136*b* ensures that contact, and resulting friction and retarding forces, between the support member 200 and the flaps 130 is avoided or mitigated until such time as the support member 200 and flaps 130 reach a point of complete deployment or of substantially complete deployment. At complete deployment, the moving support member 200 (moving in the direction 300) intersects the moving joints 130 (moving inwardly perpendicularly to direction 300) at the second or stop portion 136*b* of the notch 136. In operation, the depth of the notch 136 or, correspondingly, the width of the first and second joints 130 at the deepest point of the notch 136, is sufficient to receive the cutout 210 of the support member 200 with an overlapping portion of the flap 130 (a difference between dimension "a" and dimension "b") contacting the support member 200 to prevent further movement of the support member in the opening direction 300.

The notches 136 shown in FIG. 5 merely represent one potential example of notches advantageously used in combination with the structures disclosed herein. In other examples, the first or transitional portion 136*a* of the notches is configured differently, such as by having a curvilinear profile or by simply having a larger rectangular notch (e.g., the entire notch 136 having a depth of "dimension a" minus "dimension c").

In the example joints or flaps 130, securement members 137 (e.g., slots, cutouts, latch, attachment device, etc.) are provided to secure a first end of an elastic member 400. Correspondingly, in the example support member 200, securement members 230 (e.g., slots, cutouts, latches, attachment devices, etc.) are provided to secure a second end of the elastic member 400. In the example illustrated in FIG. 5, the securement members 137 are example slots formed in the joints or flaps 130 ("flap securement members") and the securement members 230 are example slots formed in the support member 200 ("support securement members"). In the configuration of FIG. 5, a first elastic member 400 is secured between the left flap securement member 137 and the left support securement member 230 and a second elastic member 400 is secured between the right flap securement member 137 and the right support securement member 230. These elastic members (e.g., rubber bands, etc.) couple the support member 200 to the first and second flaps or joints 130 and are adapted to bias the support member 200 into the open position and toward engagement with the notches 136.

In one example configuration, the support member 200 is installed in the shroud 120 so that a point of attachment of the axes of rotation 217 of the tabs 215 are displaced from the notches 136 to prevent the support member 200 from attaining a fully planar orientation in the open position. For example, as shown in FIG. 5, one possible point of attachment of the axes of rotation 217 of the tabs 215 is that of point "d" shown on the flaps 130, which is displaced above the stop portions 136*b* of the notches 136. Since the lateral portions of the support member 200 bearing the tabs 215 are affixed to the shroud 120 at a height above that attained by the middle portion of the support member 200 along the line of weakness or joint 220, the support member 200 cannot attain a fully planar orientation since the movement of that portion of the support member 200 is stopped by the stop portions 136*b* of the notches 136. Depending on the distance between the stop portions 136*b* of the notches 136 and the point "d" representing the axes of rotation 217 of the tabs 215, varying degrees of planarity are possible.

The slight offset of the axes of rotation 217 of the tabs 215 from the stop portions 136*b* of the notches 136 prevents the support member 200 from fully opening which in turn facilitates force vectoring and controlled collapse of the shroud 120 along joint or line of weakness 220 of the support member 200. In this configuration, when inward lateral forces are applied to central portions of sheets or sheet portions 120*a*, 120*b* (e.g., from the top and bottom directions in the orientation shown in FIG. 2) the slight variance from planarity creates, from the laterally applied force, a small initial vertical vector in a closing direction 301 of the support member 200, which assists closing against the biasing forces of the elastic members 400. This configuration also helps to ensure that, when inward lateral forces are applied to central portions of sheets or sheet portions 120*a*, 120*b*, that a vertical vector is not created in an opening direction 301 of the support member 200, which could potentially damage the stop portions 136*b* of the notches 136. Thus, the displacement of the axes of rotation 217 of the tabs 215 from the stop portions 136*b* of the notches 136 as disclosed facilitates force vectoring.

The present concepts include an example wherein the axes of rotation 217 of the tabs 215 are aligned with the stop portions 136*b* of the notches 136 and the support member 200 does attain a fully planar orientation. In such an example, controlled collapse of the shroud 120 along joint or line of weakness 220 of the support member 200 may require application of forces other that purely transverse forces to facilitate closure. For example, a user of the display may reach into a top portion of the shroud 120 to press downwardly on a topmost support member 200, against the bias of elastic members 400, to initiate downward motion of the support member 200 and closure of the shroud 120. Likewise, in an example structure where a support member 200 and flaps or joints 130 on a bottom portion of the shroud 120 is inverted relative to a support member 200 and flaps or joints 130 on a top portion of the shroud, a user of the display may alternately reach into a bottom portion of the shroud 120 to press upwardly on a bottommost support member 200, against the bias of elastic members 400, to initiate upward motion of the support member 200 and closure of the shroud 120.

In another example configuration, a plurality of support members 200 are provided in a same orientation, such as that shown in FIG. 5, as opposed to an inverted orientation. The plurality of support members 200 are advantageously ganged together via one or more connecting elements (e.g., cord, ribbon, string, bar, etc.) so that a tensile force pulling on an exposed end of one connecting element causes either simultaneous or sequential movement of the support members 200 into a closed or collapsed state. By way of example, a centrally disposed cord could connect a topmost support member 200, any intermediary support member(s) 200, and a bottommost support member 200, and extend downwardly therefrom so that a user could readily pull on it (or conversely step on it while lifting the shroud 120 and pressing inwardly) to simultaneously close support members 200.

In a configuration wherein there is a displacement along the length of the shroud 120 between the axes of rotation 217 of the tabs 215 and the stop portions 136*b* of the notches 136, inward lateral forces applied to central portions of sheets or sheet portions 120*a*, 120*b* (e.g., from the top and bottom directions in the orientation shown in FIG. 2) creates a small initial vertical vector in a closing direction 301 of the support member 200, due to the slight variance from planarity, which assists in closing the support member 200 against the biasing forces of the elastic members 400. This configuration also helps to ensure that, when inward lateral forces are applied to central portions of sheets or sheet portions 120*a*, 120*b*, that a vertical vector is not created in an opening direction 301 of the support member 200, which could potentially damage the stop portions 136*b* of the notches 136. Thus, the displacement of the axes of rotation 217 of the tabs 215 from the stop portions 136*b* of the notches 136 as disclosed facilitates force vectoring.

In one example, a first support member 200 (e.g., disposed at a top portion of the shroud) and a second support member 200 (e.g., disposed at a bottom portion of the shroud) are provided and are disposed between the first sheet portion 120*a* and the second sheet portion 120*b* and between the first joint 130 (e.g., left joint 130 in FIG. 2) and the second joint 130 (e.g., right joint 130 in FIG. 2), each support member being affixed to the first sheet portion and the second sheet portion and being movably disposed relative to the first joint and the second joint. In this example, the first support member 200 and the second support member 200 are each being positionable between a closed position and an open position, wherein, the open position outwardly biases the first sheet portion 120*a* and the second sheet portion 120*b* to cause the shroud 120 to assume a curvilinear cross-sectional shape along a length of the shroud. In this example, a first set of notches 137 is correspondingly formed in the first joint 130 and the second joint 130 at the first position along the length of the shroud (e.g., at a top portion of the shroud) and a second set of notches 137, is correspondingly formed in the first joint 130 and the second joint 130 at the second position along the length of the shroud (e.g., at a bottom portion of the shroud). As noted above, in some examples of a display apparatus, a configuration of the first support member 200 and the first set of notches 136 is an inverse of a configuration of the second support member 200 and a second set of notches 136 relative to a middle portion of the shroud 120. Thus, an orientation shown in the example of FIG. 5, shows an example structure for an example upper portion of the shroud 120 and a structure for a lower portion of the shroud is a mirror image thereof.

The combination of the inwardly projecting joints or flaps 130 and the support member(s) 200 disposed in the fully or substantially open position, such as is shown in the example of FIG. 2, provides sufficient structural rigidity to enable the erected shroud 120 to maintain its deployed shape, while also resisting forces (e.g., inward, transverse forces) that would tend to initiate closure of the shroud. As noted above, the elastic members 400 are disposed between the joints or flaps 130 and the support members 200 to bias the support members 200 and, consequently the shroud 120, into an open position. Once in the open position, the support member 200 functions as a stop preventing inward, transverse travel of the joints 130 toward one another following full engagement of the joints 130 with the slots 210 of the support member 200. With reference to the example of FIG. 2, the support member line of weakness 220 enables one half 201 of the support member 200 to rotate about this line of weakness 220 relative to the other half 202 of the support member 200 in response to transverse forces applied to generally center portions of the shroud 120 faces (e.g., left-to-right inward force applied to the left sheet 120*a* and right-to-left inward force applied to right sheet 120*b* in FIG. 1, etc.). Thus, the line of weakness 220 facilitates movement of the erectable display 100 between a deployed position and a folded position. In the folded position of the support member 200, such as is represented in FIG. 4(*a*), for example, the first sheet portion 120*a* and the second sheet portion 120*b* are disposed adjacent one another and the shroud 120 assumes a substantially flat shape along a length of the shroud.

Figure 4A:
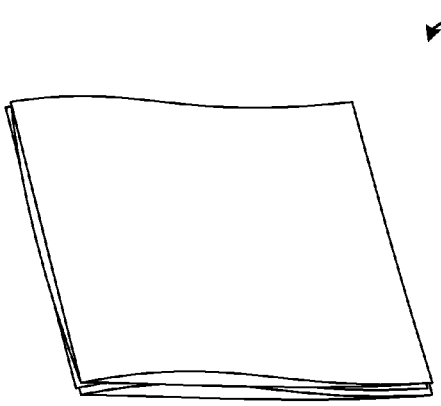
FIGS. 4(*a*)-4(*c*) illustrate different aspects of an example of erecting an auto-erecting display by unfolding the shroud from a substantially flat initial state, in accord with teachings disclosed herein.
Figure 4B:
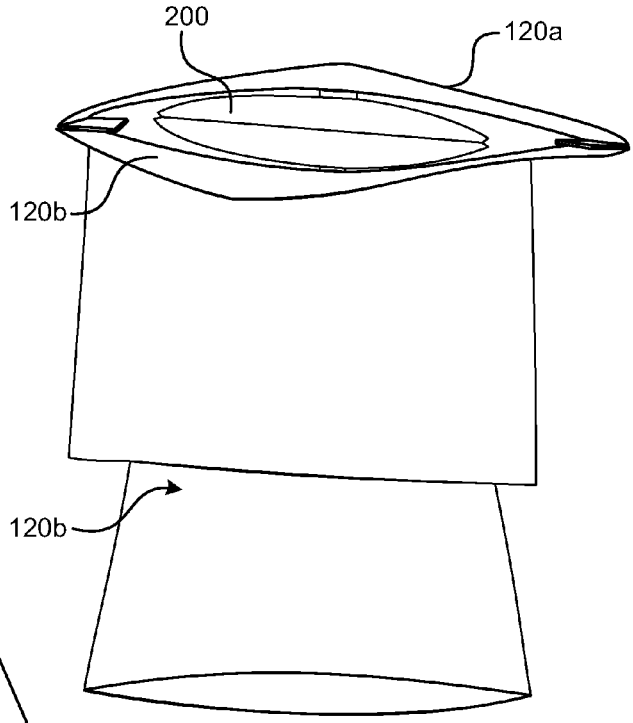
Figure 4C:
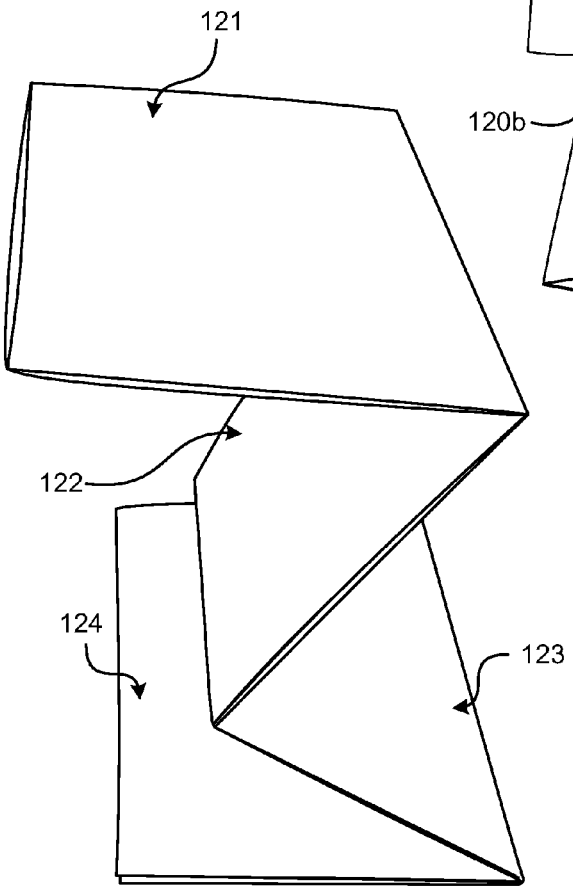

FIGS. 4(*a*)-4(*c*) illustrate different aspects of an example of erecting an auto-erectable display 100, from a substantially flat initial state (FIG. 4(*a*)) to an erected state (FIG. 1), in accord with at least some aspects of the concepts disclosed herein. FIG. 4(*a*) shows a stowed or folded auto-erectable display 100. FIG. 4(*b*) shows a state in which the auto-erectable display 100 is partially unfolded, with a top segment of the display showing not only the first sheet 120*a* and second sheet 120*b* forming the shroud 120, but also the mostly folded support member 200 disposed within the top segment 121. In the folded or partially-folded state, the joints 130 are spaced apart from and are disengaged from the support member 200. FIG. 4(*c*) shows a side view of approximately the state shown in FIG. 4(*b*), such view emphasizing the stacking arrangement of the different segments of the auto-erectable display 100 onto one another when in the stowed or folded state. Each of the segments 121-124 is hinged, through the various lines of weakness, so that each segment folds upon the underlying segment.

In some examples, the auto-erecting display 100 is configured to automatically deploy (open fully) once it has been unfolded or unfurled. Stated differently, in such examples, the biasing forces of the elastic members 400 against the support members 200 is sufficient to automatically open the support members to thereby force the sheet portions 120*a*, 120*b* outwardly to form the tubular shroud 120. In other examples, additional elastic members are optionally disposed between adjacent segments (e.g., connecting segment 121 to segment 122, etc.) to provide additional biasing forces about the lines of weakness or joints between such adjacent segments to assist the unfolding or unfurling of the folded auto-erecting display 100.

Figure 6A:
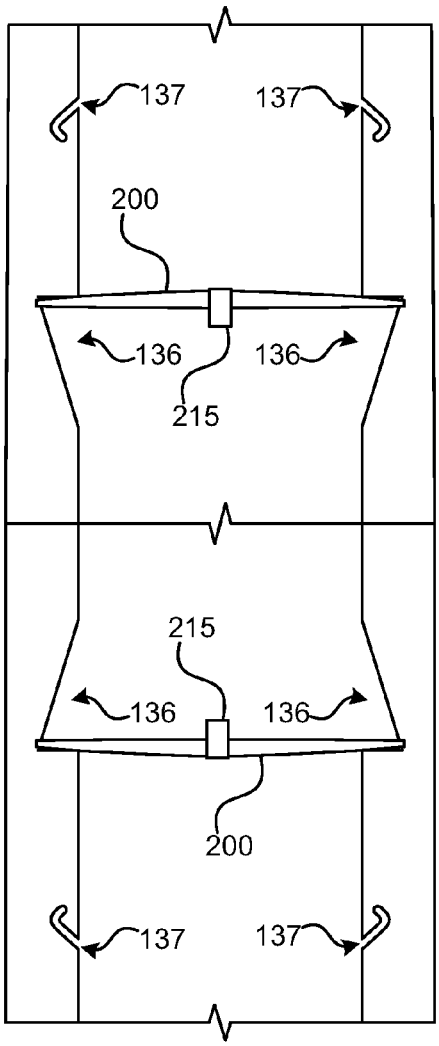
FIGS. 6(*a*)-6(*c*) are, respectively, a side cross-sectional view, a top view and a bottom view of an erected auto-erecting display in accord with teachings disclosed herein.
Figure 6B:
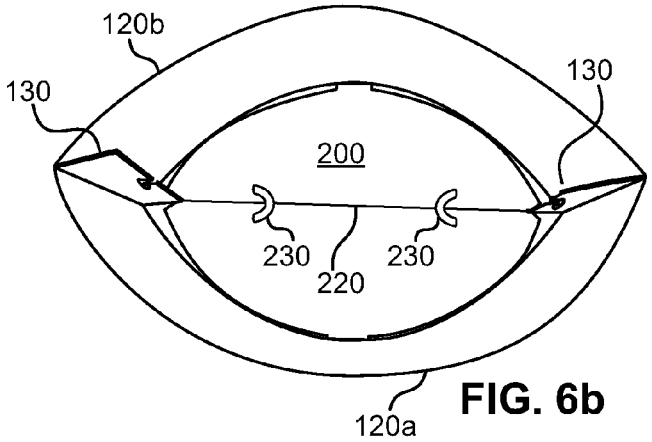
Figure 6C:
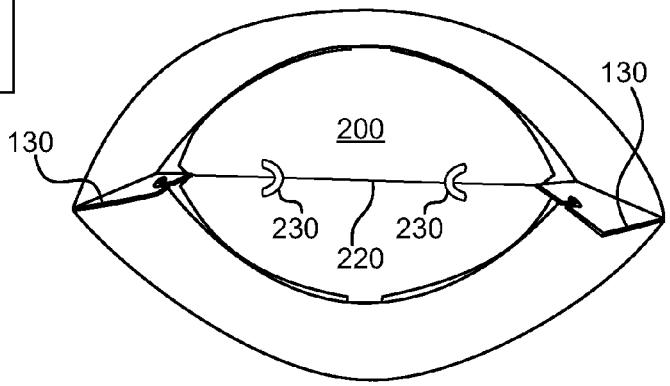

The auto-erecting processing starts generally with the example acts shown in FIGS. 4(*a*)-4(*c*), and leads to the resulting erected state shown in FIG. 1. This process can be readily reversed, as is represented in the views of FIGS. 6(*a*)-8(*c*), which respectively show a side cross-sectional view, a top view and a bottom view of an auto-erecting display in an open or deployed state (FIGS. 6(*a*)-6(*c*)), a partially-collapsed state (FIGS. 7(*a*)-7(*c*)), and a collapsed state prior to folding for stowage (FIGS. 8(*a*)-8(*c*)). To transition from the open state (FIGS. 6(*a*)-6(*c*)) to a collapsed state, a user gently squeezes the sides of the display along center portions of the faces of the sheets or sheet portions 120*a*, 120*b* (e.g., left-to-right inward force applied to the left sheet 120*a* and right-to-left inward force applied to right sheet 120*b* in FIG. 1, etc.) to counter the bias of the elastic members 400 and inwardly deform the curvilinear aspect of the erected sheets 120*a*, 120*b*, and, via the connection(s) between the support member(s) 200 and the sheets (e.g., tabs 215 and adhesive 216) and the sheets 120*a*, 120*b*. This deformation correspondingly causes a rotation of the support member(s) 200 about the line(s) of weakness 220. Simultaneously, the joints 130 formed by the flaps 130*a*, 130*b*, and notches 136, move out of engagement with and move away from the support member cutouts 210. This motion continues until the support member first half 201 is folded over the second half 202, achieving a folded state (see FIGS. 8(*a*)-8(*c*)), at which point the tubular shroud 120 is itself in a substantially flattened state. The flattened shroud 120 is then further foldable about the lines of weakness formed between the various segments (e.g., 121-124) to achieve the folded state shown in FIG. 4(*a*).

While the example herein shows a generally elliptical shaped support member 200 used to cause the sheets to assume a corresponding elliptical profile, the teachings herein expressly include the use of other shapes and/or sizes of support members and/or other lines of weakness (e.g., vertical lines of weakness) formed in the sheets or sheet portions 120*a*, 120*b* to allow a realization of other shroud profiles (e.g., rhomboid, etc.).

Figure 9A:
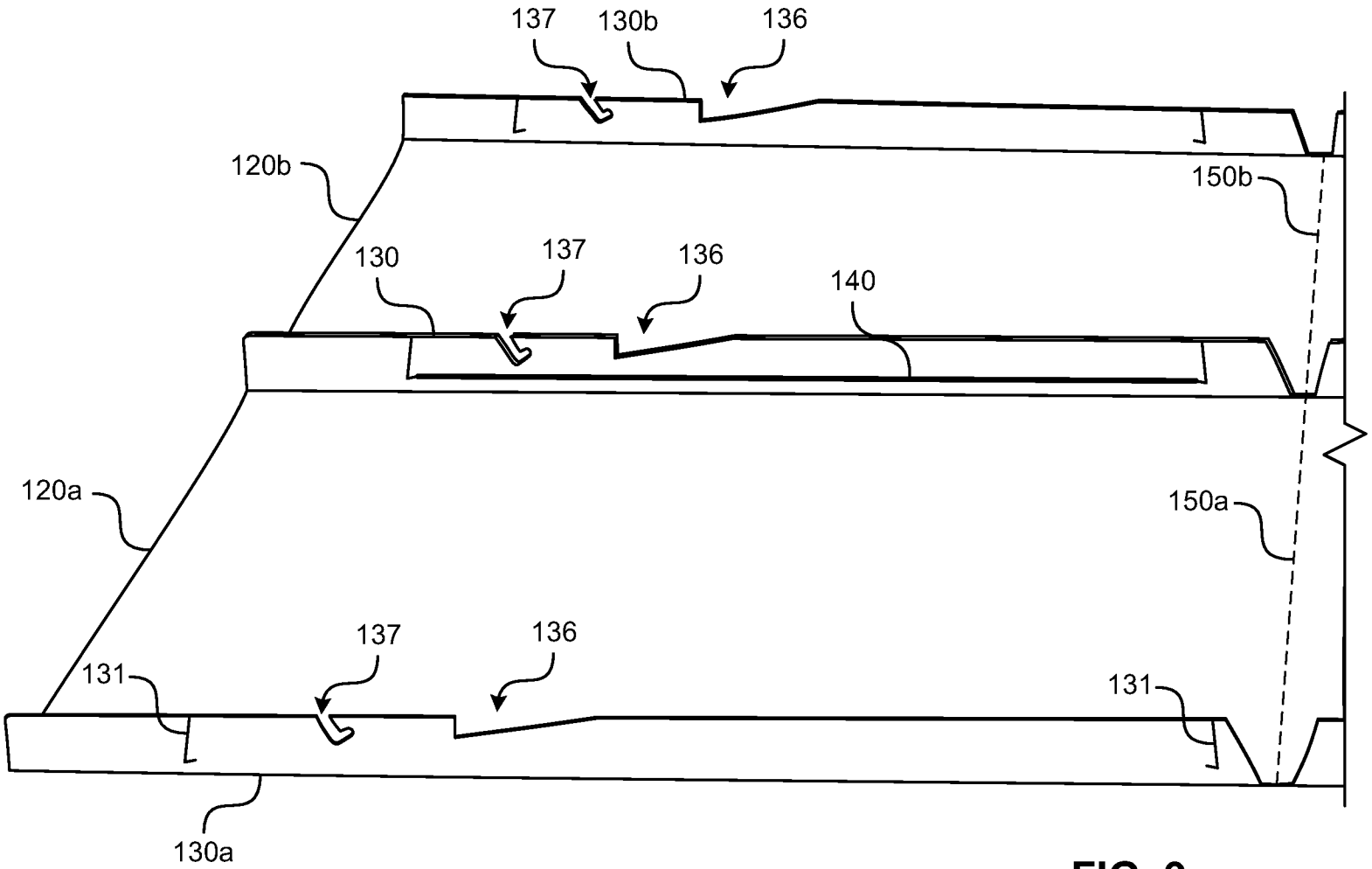
FIGS. 9(*a*)-9(*c*) illustrate an example of construction of an example of an erectable display in accord with teachings disclosed herein.
Figure 9B:
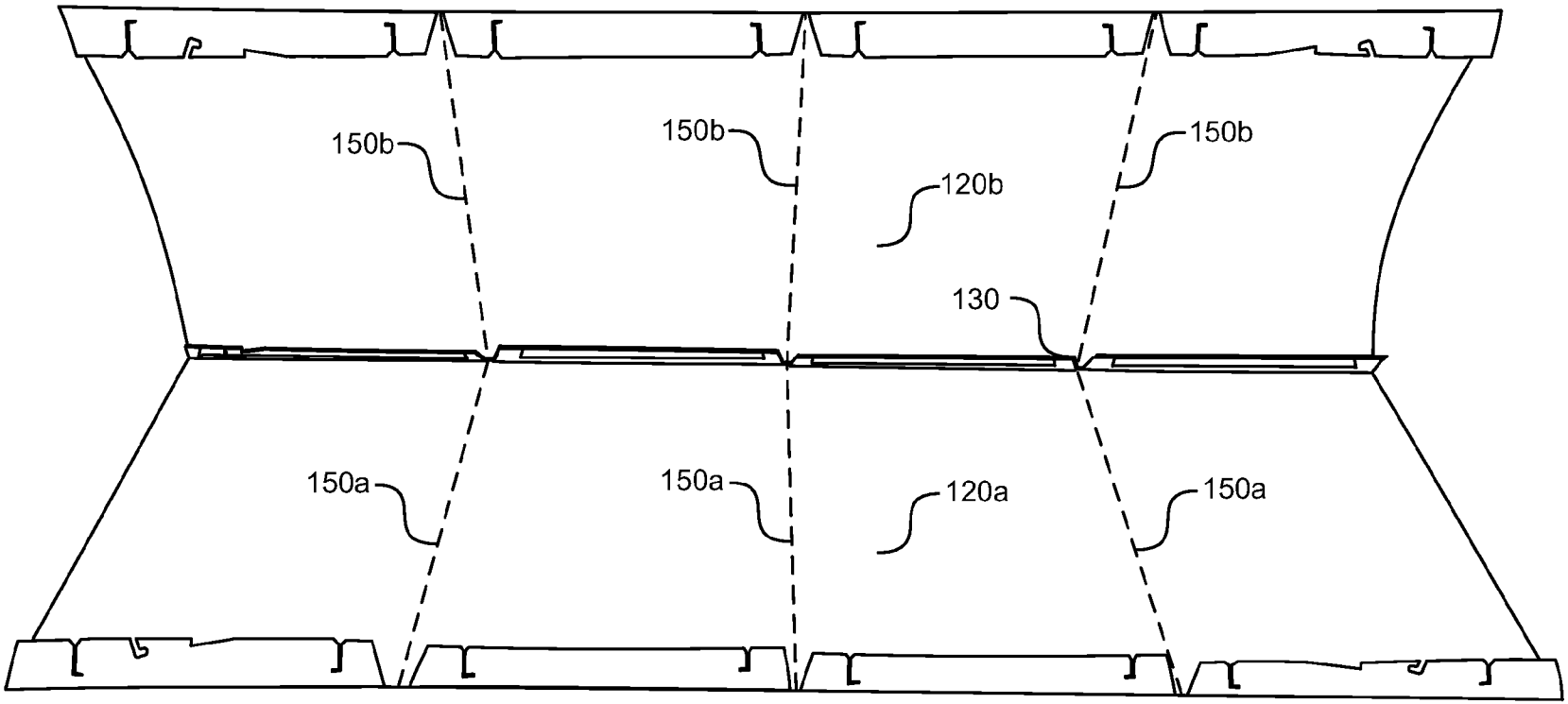
Figure 9C:
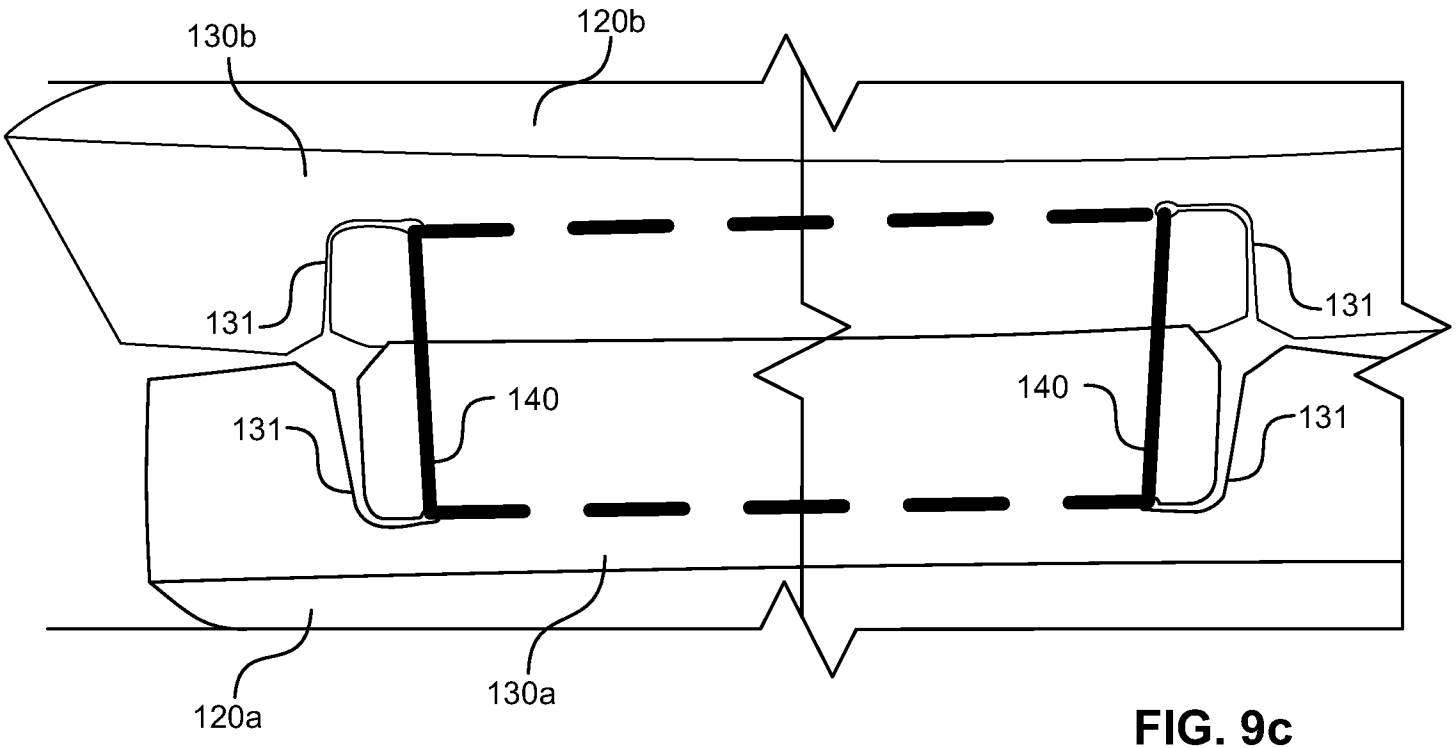

FIGS. 9(*a*)-9(*c*) illustrate an example of construction of an example of an auto-erectable display 100 in accord with at least some aspects of the concepts disclosed herein.

The example method includes, as shown in FIG. 9(*a*), disposing a first sheet 120*a* having a first lateral end 130*a* and a second lateral end 130*a* adjacent to a second sheet 120*b* having a first lateral end 130*b* and a second lateral end 130*b*. Also shown in FIG. 9(*a*) are features 131 (e.g., slits, etc.), notches 136 in the flaps 130*a*-130*b*, and spaced apart lines of weakness 150*a*, 150*b* defining boundaries of adjacent segments along a length of the sheets, as described above. The method includes the act of connecting a lateral end of the first sheet 120*a* to the adjacent lateral end of the second sheet 120*b* to form a first joint 130, as is shown in FIG. 9(*a*). The method further includes the act of connecting the remaining free lateral end of the first sheet 120*a* to the remaining free lateral end of the second sheet 120*b* to form a second joint 130, as is shown generally in FIGS. 9(*b*)-9(*c*), with FIG. 9(*b*) showing that the sheet 120*b* is being folded over the first sheet 120*a* to place the free flaps 130*b* of sheet 120*b* adjacent the free flaps 130*a* of sheet 120*a*. So positioned, the free flaps 130*a*, 130*b* may then be connected using the connection member(s) 140. In the example shown in FIG. 9(*c*), a single resilient connection member 140 is passed through a first feature 131 (e.g., slits) formed in one portion of the flaps 130*a*, 130*b* and a second feature 131 (e.g., another slit) formed in another portion of the flaps 130*a*, 130*b*. In some examples, different features are optionally provided at different portions of the flaps to facilitate connection of the flaps. For example, a first feature 131 includes a slit, whereas a second feature 131 includes a hole or an eyelet.

The method further includes the act of disposing a support member 200 between the first sheet 120*a* and the second sheet 120*b* to extend between the first joint 130 and the second joint 130 (see, e.g., FIG. 2). In this example method, the support member 200 is movable between an open position (e.g., corresponding to a display apparatus 100 erected state (see, e.g., FIG. 1)) and a closed position (e.g., corresponding to a display apparatus stowed state (see, e.g., FIG. 4(*a*))). In another example, a plurality of movable support members 200 are disposed between the first sheet 120*a* and the second sheet 120*b* to extend between the first joint 130 and the second joint 130, the support members 200 being movable between an open position and a closed position.

The method further includes the acts of attaching a first end of a first elastic member 400 to the support member 200, attaching a second end of the first elastic member 400 to the first joint 130, attaching a first end of a second elastic member 400 to the support member 200 and attaching a second end of the second elastic member to the second joint 130. The elastic members may comprise, by way of example, rubber bands. In some examples, the first end of the first elastic member is attached to a securement member 230 formed in the support member 200 and a second end of the first elastic member is attached to a securement member 137 formed in a first joint 130. Likewise, a first end of a second elastic member is attached to a securement member 230 formed in the support member 200 and a second end of the second elastic member is attached to a securement member 137 formed in a second joint 130. The example method further includes the act of collapsing the shroud 120 by moving the first sheet 120*a* and the second sheet 120*b* toward one another, as is represented in FIGS. 6(*a*)-8(*c*), and by moving the support member 200 from the open position (see, e.g., FIG. 2) to the closed position against bias from the first elastic member 400 and the second elastic member 400 and folding the shroud along the transverse lines of weakness 150 (e.g., progressing from, for example, FIGS. 4(*c*) to 4(*a*)) (see, e.g., FIGS. 9(*a*)-9(*c*)).

A further act may optionally include that of automatically deploying the display apparatus 100 by unfolding the shroud 120, the act of unfolding enabling the elastic members 400 to automatically bias the support members 200 into an open position.

Likewise, the method of forming the display apparatus 100 includes the act of stowing the display apparatus 100 by moving the first joint 130 away from the second joint 130, such as by applying inward lateral forces to center portions of the sheet portion 120*a* and sheet portion 120*b* to move the support member(s) 200 from the open position (e.g., substantially planar) to the closed position (e.g., folded) and transition the display apparatus 100 from the erected state (see, e.g., FIG. 1) to the stowed state (see, e.g., FIG. 4(*a*)).

In one example embodiment, a display apparatus is provided including a shroud having a first sheet portion and a second sheet portion disposed in opposition to one another, the first sheet portion and the second sheet portion being connected to one another at a first side by a first joint and at a second side by a second joint. The display apparatus also includes a support member disposed between the first sheet portion and the second sheet portion and between the first joint and the second joint, the support member being affixed to the first sheet portion and the second sheet portion and being movably disposed relative to the first joint and the second joint, the support member being positionable between a closed position and an open position, the open position outwardly biasing the support member against the first sheet portion and the second sheet portion to cause the shroud to assume a curvilinear cross-sectional shape along a length of the shroud. Notches are formed in the first joint and the second joint at a first position along the length of the shroud. One or more elastic members couple the support member to at least one of the first joint and the second joint, the one or more elastic members being adapted to bias the support member into the open position and toward engagement with the notches.

In another example, in the aforementioned example embodiment of the display apparatus, compressive forces applied to central portions of the first sheet portion and the second sheet portion are directed along a minor axis of the support member to cause the support member to rotate about a major axis of the support member to transition the support member from the open state toward the closed state.

In another example, in the aforementioned example embodiment of a display apparatus, compressive forces applied to central portions of the first sheet portion and the second sheet portion cause outward movement of the first joint and the second joint away from the support member to disengage the support member from the notches.

In another example, in the aforementioned example embodiment of a display apparatus, a first portion of the support member includes a first attachment member and a second portion of the support member includes a second attachment member, wherein the first joint includes a first attachment member, wherein the second joint includes a second attachment member, wherein a first elastic member is attached, at a first end, to the first attachment member of the support member and is attached, at a second end, to the first attachment member of the first joint, and wherein a second elastic member is attached, at a first end, to the second attachment member of the support member and is attached, at a second end, to the second attachment member of the first joint. In a further example, the first attachment member and the second attachment member of the support member include cutouts formed in the support member.

In another example, a display apparatus includes a shroud including a first substrate having a first lateral flap and a second lateral flap, the substrate being folded in half to place the first lateral flap of a first half and the second lateral flap of a second half in opposition to one another, with the fold forming a first joint and the first lateral flap and the second lateral flap being connected to form a second joint. A support member is disposed between the first half of the substrate and the second half of the substrate and between the first joint and the second joint. The support member is affixed to the first half of the substrate and the second half of the substrate and is movably disposed relative to the first joint and the second joint. The support member is positionable between a closed position and an open position, the open position outwardly biasing the support member against the first half of the substrate and the second half of the substrate to cause the shroud to assume a curvilinear cross-sectional shape along a length of the shroud. A notch formed in at least the second joint at a first position along the length of the shroud. An elastic member couples the support member to the notch and is configured to bias the support member into the open position and toward engagement with the notch. The support member is, in some examples, an ovoid, elliptical or oblong shape. The support member is, in some other examples, a truncated ovoid, a truncated elliptical or a truncated oblong shape.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A display apparatus, comprising:

a shroud including a first sheet portion and a second sheet portion disposed in opposition to one another and connected to one another at a first side by a first joint and at a second side by a second joint;

a support member disposed between the first sheet portion and the second sheet portion and between the first joint and the second joint, the support member being affixed to the first sheet portion and the second sheet portion and movable between a closed position and an open position, the open position outwardly biasing the support member against the first sheet portion and the second sheet portion to cause the shroud to assume a curvilinear cross-sectional shape along a length of the shroud;

notches formed in the first joint and the second joint at a first position along the length of the shroud, the support member engaged with the notches in the open position and disengaged from the notches in the closed position; and an elastic member coupling the support member to at least one of the first joint and the second joint, the elastic member biasing the support member into the open position and toward engagement with the notches.

2. The display apparatus of claim 1, wherein the support member includes at least one of an ovoid, elliptical or oblong shape.

3. The display apparatus of claim 1, wherein the support member includes a line of weakness extending along the support member, from the first joint to the second joint, and defining a first half and a second half of the support member.

4. The display apparatus of claim 1, wherein the support member is affixed to the first sheet portion and the second sheet portion via a plurality of tabs.

5. The display apparatus of claim 4, wherein axes of rotation of the plurality of tabs are displaced from the notches to prevent the support member from attaining a fully planar orientation in the open position.

6. The display apparatus of claim 1, wherein the support member is affixed to the first sheet portion and the second sheet portion via an adhesive.

7. The display apparatus of claim 1, wherein the support member is affixed to the first sheet portion and the second sheet portion via a plurality of tabs, and wherein the plurality of tabs are affixed to the first sheet portion and the second sheet portion via adhesives.

8. The display apparatus of claim 1, wherein the support member includes a first support member and a second support member, disposed between the first sheet portion and the second sheet portion and between the first joint and the second joint, each of the first support member and the second support member being affixed to the first sheet portion and the second sheet portion and movable between a closed position and an open position, the open position of the first support member and the second support member outwardly biasing the first sheet portion and the second sheet portion to cause the shroud to assume a curvilinear cross-sectional shape along a length of the shroud, the first support member being disposed at a top portion of the shroud and the second support member being disposed at a bottom portion of the shroud, wherein the notches include a first set of notches and a second set of notches, the first set of notches being formed in the first joint and the second joint at the first position along the length of the shroud, the first position being disposed at a top portion of the shroud, the second set of notches being formed in the first joint and the second joint at a second position along the length of the shroud, the second position being disposed at a bottom portion of the shroud, the first support member engaged with the first set notches in the open position and disengaged from the first set notches in the closed position, and the second support member engaged with the second set of notches in the open position and disengaged from the second set of notches in the closed position.

9. The display apparatus of claim 1, wherein, in the closed position of the support member, the first sheet portion and the second sheet portion are disposed adjacent one another to cause the shroud to assume a substantially flat shape.

10. The display apparatus of claim 1, wherein the notches include a first notch formed in the first joint at a first position along the length of the shroud and a second notch formed in the second joint at the first position along a longitudinal axis of the shroud; and wherein contact between the support member and the first notch of the first joint and the second notch of the second joint stops inward transverse travel of the joints at a position corresponding to the open position.

11. The display apparatus of claim 1, wherein the first sheet portion and the second sheet portion are different parts of a same sheet, and wherein the first joint is a fold in the sheet, defining a separation between the first sheet portion and the second sheet portion.

12. The display apparatus of claim 1, wherein lateral edges of the support member are affixed to the first sheet portion and the second sheet portion at at least a first point on the first sheet portion between the first joint and the second joint and a second point on the second sheet portion between the first joint and the second joint, and wherein the first point and the second point are displaced from the notches, along a longitudinal axis of the shroud, to prevent the support member from attaining a fully planar orientation in the open position.

13. The display apparatus of claim 1, wherein the support member is substantially planar in the open position.

14. The display apparatus of claim 1, wherein the first joint and the second joint extend along a longitudinal axis of the display, wherein the support member includes a central portion movable along the longitudinal axis, and the support member includes a first lateral side and a second lateral side, the first lateral side spaced apart from the first joint in the closed position, and the second lateral side spaced apart from the second joint in the closed position.

15. A method of forming a display apparatus, comprising:

disposing a first sheet having lateral ends adjacent to a second sheet having lateral ends, each of the first sheet and second sheet having transverse lines of weakness spaced apart along a length thereof;

connecting a lateral end of the first sheet to a lateral end of the second sheet to form a first joint;

connecting another lateral end of the first sheet to another lateral end of the second sheet to form a second joint and to define a shroud structure;

disposing a support member between the first sheet and the second sheet between the first joint and the second joint so that a first side of the support member is attached to the first sheet, a second side of the support member is attached to the second sheet, and a central portion of the support member including a third side and a fourth side of the support member is movable between an open position in which the third side of the support member engages the first joint and the fourth side of the support member engages the second joint and a closed position in which the third side of the support member is spaced apart from the first joint and the fourth side of the support member is spaced apart from the second joint;

attaching a first end of a first elastic member to the support member and attaching a second end of the first elastic member to the first joint;

attaching a first end of a second elastic member to the support member and attaching a second end of the second elastic member to the second joint;

collapsing the shroud by moving the first sheet and the second sheet toward one another and by moving the support member from the open position to the closed position against bias from the first elastic member and the second elastic member; and folding the shroud along the transverse lines of weakness.

16. The method of forming the display apparatus of claim 15, further including:

automatically deploying the display apparatus by unfolding the shroud.

17. The method of forming the display apparatus of claim 15, wherein the first end of the first elastic member is attached to a securement member formed in the support member, and wherein the first end of the second elastic member is attached to a securement member formed in the support member.

18. The method of forming the display apparatus of claim 15, wherein the second end of the first elastic member is attached to a securement member formed in the first joint, and wherein the second end of the second elastic member is attached to a securement member formed in the second joint.

19. The method of forming the display apparatus of claim 15, further including:

attaching the support member to the first sheet and the second sheet.

20. The method of forming the display apparatus of claim 19, wherein the act of attaching the support member to the first sheet and the second sheet utilizes an adhesive.

21. The method of forming the display apparatus of claim 15, wherein the support member includes a first support member and a second support member, the first support member being disposed at a top half of the shroud and the second support member being disposed at a bottom half of the shroud.

22. The method of forming the display apparatus of claim 15, wherein a width of the first joint and the second joint is greater than a depth of lateral cutouts formed in the support member at distal ends of a major axis thereof, and wherein a depth of the lateral cutouts formed in the support member is greater than a width of the first joint and the second joint at a deepest portion of notches formed in each of the first joint and the second joint.

* * * * *